US010505296B1

(12) United States Patent
Huang

(10) Patent No.: US 10,505,296 B1
(45) Date of Patent: Dec. 10, 2019

(54) TRACK LIGHT STRUCTURE AND EARTH TERMINAL FITTING THEREOF

(71) Applicant: KING ONE PRODUCTS CO., Taichung (TW)

(72) Inventor: Ching Fu Huang, Taichung (TW)

(73) Assignee: King One Products Co., Taichung (TW)

( * ) Notice: Subject to any disclaimer, the term of this patent is extended or adjusted under 35 U.S.C. 154(b) by 0 days.

(21) Appl. No.: 16/277,109

(22) Filed: Feb. 15, 2019

(51) Int. Cl.
*H01R 25/00* (2006.01)
*H01R 9/24* (2006.01)
*F21V 23/06* (2006.01)

(52) U.S. Cl.
CPC ..... *H01R 9/2491* (2013.01); *F21V 23/06* (2013.01); *H01R 9/2483* (2013.01)

(58) Field of Classification Search
CPC ..... H01R 9/2483; H01R 9/2491; F21V 23/06
USPC ..... 439/121, 709
See application file for complete search history.

(56) References Cited

U.S. PATENT DOCUMENTS 2,987,693 A * 6/1961 Wamsley ..... H01R 13/62933 439/157
3,044,035 A * 7/1962 Adams, Jr. ..... H01R 25/142 439/115
3,963,294 A * 6/1976 Heritage ..... F21V 21/02 439/121
4,053,194 A * 10/1977 Gilman ..... H01R 25/145 439/115
4,108,523 A * 8/1978 Bolis ..... H01R 25/142 439/116
4,163,595 A * 8/1979 Vasseur ..... H01R 25/142 439/121
4,822,292 A * 4/1989 Thayer ..... H01R 25/142 439/115
5,679,016 A * 10/1997 Marder ..... F21V 23/06 439/171
5,855,485 A * 1/1999 Patti ..... H01R 25/142 439/121
5,876,235 A * 3/1999 Yoshigi ..... H01R 25/006 439/384
6,203,339 B1 * 3/2001 Nieminen ..... H01R 25/14 439/118
6,527,598 B1 * 3/2003 Opel ..... H01R 9/2408 439/709
6,634,895 B2 * 10/2003 Agro ..... F21S 8/06 439/121

(Continued)

*Primary Examiner* — Abdullah A Riyami
*Assistant Examiner* — Vladimir Imas
(74) *Attorney, Agent, or Firm* — Rosenberg, Klein & Lee

(57) ABSTRACT

A track light structure and an earth terminal fitting are disclosed. The track light structure includes a light body having a terminal block. The terminal block has two conductive terminals for connecting a live wire and a neutral wire. The terminal block has a socket communicating with the light body for insertion of a pin extending from the underside of a base of an earth terminal fitting, so that the pin is electrically connected to the light body. The base has a connecting portion and a conductive member electrically connected to the pin. The conductive member is configured to connect an earth wire. The earth terminal fitting is selectively connected to the terminal block through the connecting portion, thereby changing the track light to a three-terminal or two-terminal configuration.

4 Claims, 6 Drawing Sheets

(56) References Cited

U.S. PATENT DOCUMENTS

| | | | | |
|---|---|---|---|---|
| 6,884,095 | B1 * | 4/2005 | Tsai | H01R 25/142 439/118 |
| 7,140,888 | B1 * | 11/2006 | Chan | H01R 25/142 439/119 |
| 7,513,675 | B2 * | 4/2009 | Mier-Langner | F21S 8/038 362/147 |
| 7,520,763 | B1 * | 4/2009 | Buse | H01R 25/142 439/121 |
| 7,690,950 | B2 * | 4/2010 | Owen, Sr. | B60R 16/0207 439/336 |
| 7,758,358 | B1 * | 7/2010 | Mier-Langner | H01R 25/142 362/219 |
| 7,914,198 | B2 * | 3/2011 | Mier-Langner | F21S 8/038 361/674 |
| 7,931,506 | B2 * | 4/2011 | Owen, Sr. | B60R 16/0207 362/581 |
| 8,858,258 | B2 * | 10/2014 | Stokowski | H01R 13/42 439/582 |
| 8,882,309 | B2 * | 11/2014 | Moser | F21V 19/0005 362/368 |
| 8,888,512 | B2 * | 11/2014 | Hoffnneister | H01R 25/14 439/121 |
| 8,963,378 | B1 * | 2/2015 | Fornage | H01R 13/639 307/147 |
| 9,222,658 | B2 * | 12/2015 | Midy | H01R 33/09 |
| 9,410,681 | B2 * | 8/2016 | Yao | F21V 21/00 |
| 9,755,408 | B2 * | 9/2017 | Taylor | E04F 10/0648 |
| 10,317,064 | B2 * | 6/2019 | Ozawa | F21V 23/06 |
| 2003/0107891 | A1 * | 6/2003 | Kohen | F21V 21/03 362/253 |
| 2010/0271847 | A1 * | 10/2010 | Mobarak | F21V 21/35 362/648 |
| 2018/0048085 | A1 * | 2/2018 | Fuda | H01R 13/44 |

* cited by examiner

TRACK LIGHT STRUCTURE AND EARTH TERMINAL FITTING THEREOF

FIELD OF THE INVENTION

The present invention relates to lighting equipment, and more particularly to a track light structure and an earth terminal fitting thereof.

BACKGROUND OF THE INVENTION

A copper conductive plate connected to a power source is embedded in the track of a track light as a wire for transmitting electric power. When the track light is mounted to the track, its conductive terminals are connected to the conductive plate to obtain electricity. The wiring of the copper conductive plate of the track on the market may be a three-wire configuration or a two-wire configuration. The interior of the three-wire track is provided with three copper conductive plates as a fire wire, a neutral wire and an earth wire. The interior of the two-wire track is provided with two copper conductive plates as a fire wire and a neutral wire. The three-wire track and two-wire track must be mated with a three-terminal track light and a two-terminal track light, respectively. Different types of tracks and track lights cannot be mated with each other.

Therefore, a replaceable terminal block fitting is developed. As shown in FIG. 8, a track light structure includes a light body 6 and a terminal block fitting 7. The terminal block fitting 7 is screwedly connected to the light body 6. The terminal block fitting 7 may be a three-terminal fitting 71 and a two-terminal fitting 72. An appropriate terminal block fitting is selected according to the type of track. However, for the assembly between the terminal block fitting 7 and the light body 6, it is required to consider the screwed operation and the wiring. Thus, it is not easy for the general public.

Accordingly, the inventor of the present invention has devoted himself based on his many years of practical experiences to solve these problems.

SUMMARY OF THE INVENTION

The primary object of the present invention is to provide a track light structure and an earth terminal fitting thereof. The earth terminal fitting can be selectively assembled to or disassembled from the track light according to the wiring of the track, so that the track light is changed to a three-terminal or two-terminal configuration to be mounted to a corresponding track, thereby improving versatility.

According to one aspect of the present invention, an earth terminal fitting of a track light is provided. The terminal fitting is selectively mounted to the two-terminal style track light. The track light has a terminal block. The terminal block has two conductive terminals for connecting a live wire and a neutral wire. The earth terminal fitting comprises a base, a connecting portion, and a conductive member. The base has a pin extending from an underside of the base to be electrically connected to the track light. The connecting portion is disposed on the base to be fixedly connected to the terminal block. The conductive member is disposed on the base and electrically connected to the pin for connecting an earth wire.

Preferably, the connecting portion is a pair of claws respectively located on opposite sides of the base.

According to another aspect of the present invention, a track light structure is provided. The track light structure comprises a light body and an earth terminal fitting. The light body includes a terminal block. The terminal block has two conductive terminals for connecting a live wire and a neutral wire. The terminal block has a socket communicating with the light body. The earth terminal fitting has a base with a pin extending from an underside of the base. The pin is inserted into the socket and electrically connected to the light body. The base has a connecting portion and a conductive member electrically connected to the pin. The conductive member is configured to connect an earth wire. The earth terminal fitting is selectively connected to the terminal block through the connecting portion.

In an embodiment, two opposite sides of the terminal block are provided with engaging grooves, respectively. The connecting portion is a pair of claws respectively located on opposite sides of the base. The claws are engaged in the corresponding engaging grooves so that the earth terminal fitting is fixedly connected to the terminal block.

Embodiments of the present invention will now be described, by way of example only, with reference to the accompanying drawings.

DETAILED DESCRIPTION OF THE PREFERRED EMBODIMENTS

Figure 1:
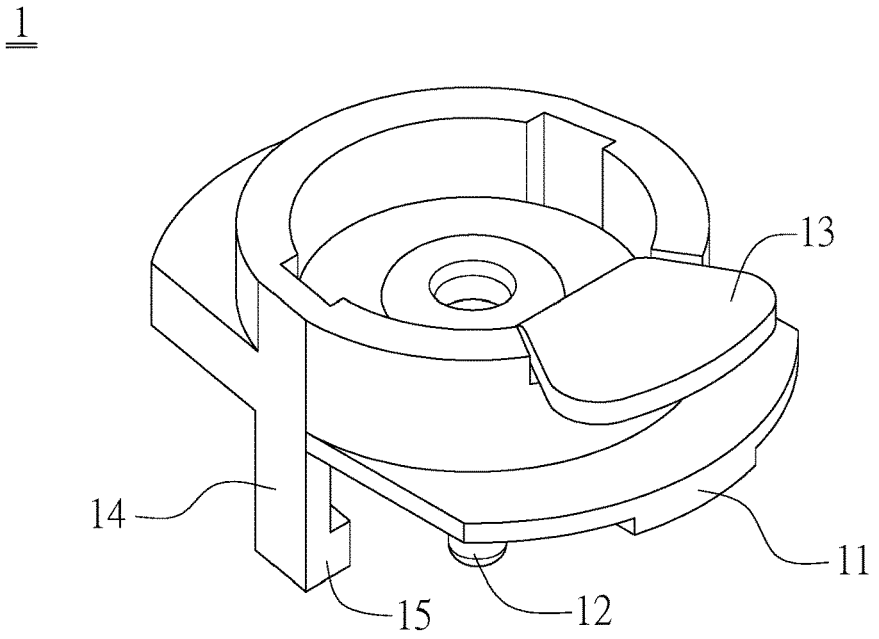
FIG. 1 is a perspective view of the earth terminal fitting of the present invention.
Figure 2:
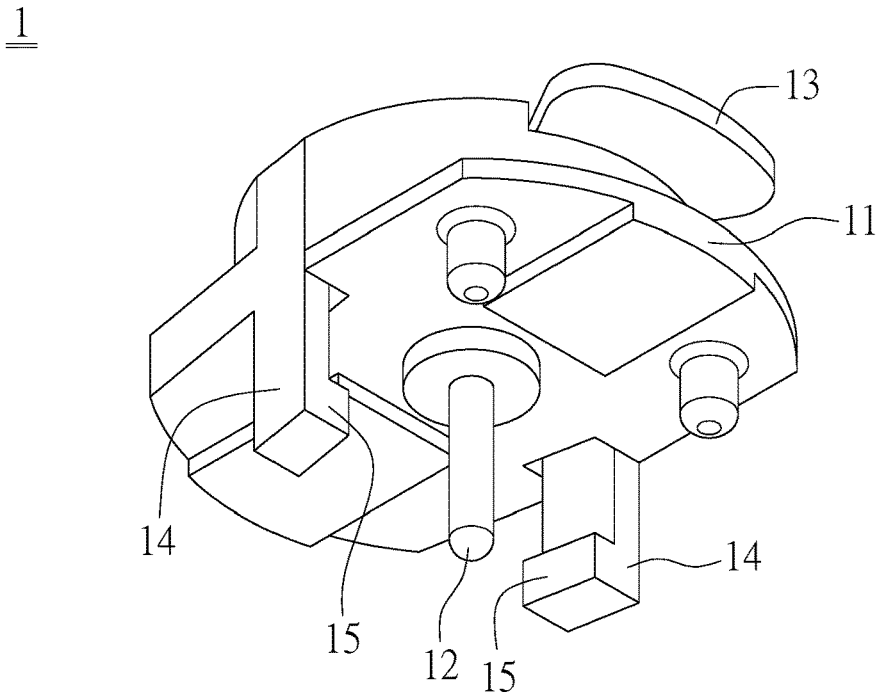
FIG. 2 is another perspective view of the earth terminal fitting of the present invention.

Referring to FIG. 1 and FIG. 2, the present invention discloses an earth terminal fitting of a two-terminal style track light as a separate component that can be selectively mounted to the track light. The two-terminal style track light is a track light having a terminal block with two conductive terminals. The two conductive terminals extend out from the terminal block to be connected with a live wire and a neutral wire of a track, respectively.

The earth terminal fitting 1 of the present invention includes a base 11 and at least one conducting portion (e.g. a pin 12 extending downward from the underside of the base 11) to be electrically connected to the track light. The top of the base 11 is provided with a conductive member 13 electrically connected to the pin 12 for connecting with an earth wire in the track.

The base 11 is provided with a connecting portion fixedly connected to the terminal block, such that the earth terminal fitting 1 of the present invention is mounted to the track light. In this embodiment, the connecting portion is a pair of claws 14 respectively located on opposite sides of the base 11 and extending downward. The ends of the claws 14 are formed with hooks 15 facing each other for hooking the terminal block, providing a retaining effect. When the earth terminal fitting 1 of the present invention is mounted to the track light, the track light is changed from a two-terminal configuration to a three-terminal configuration used for a three-wire track (including a live wire, a neutral wire and an earth wire).

Figure 3:
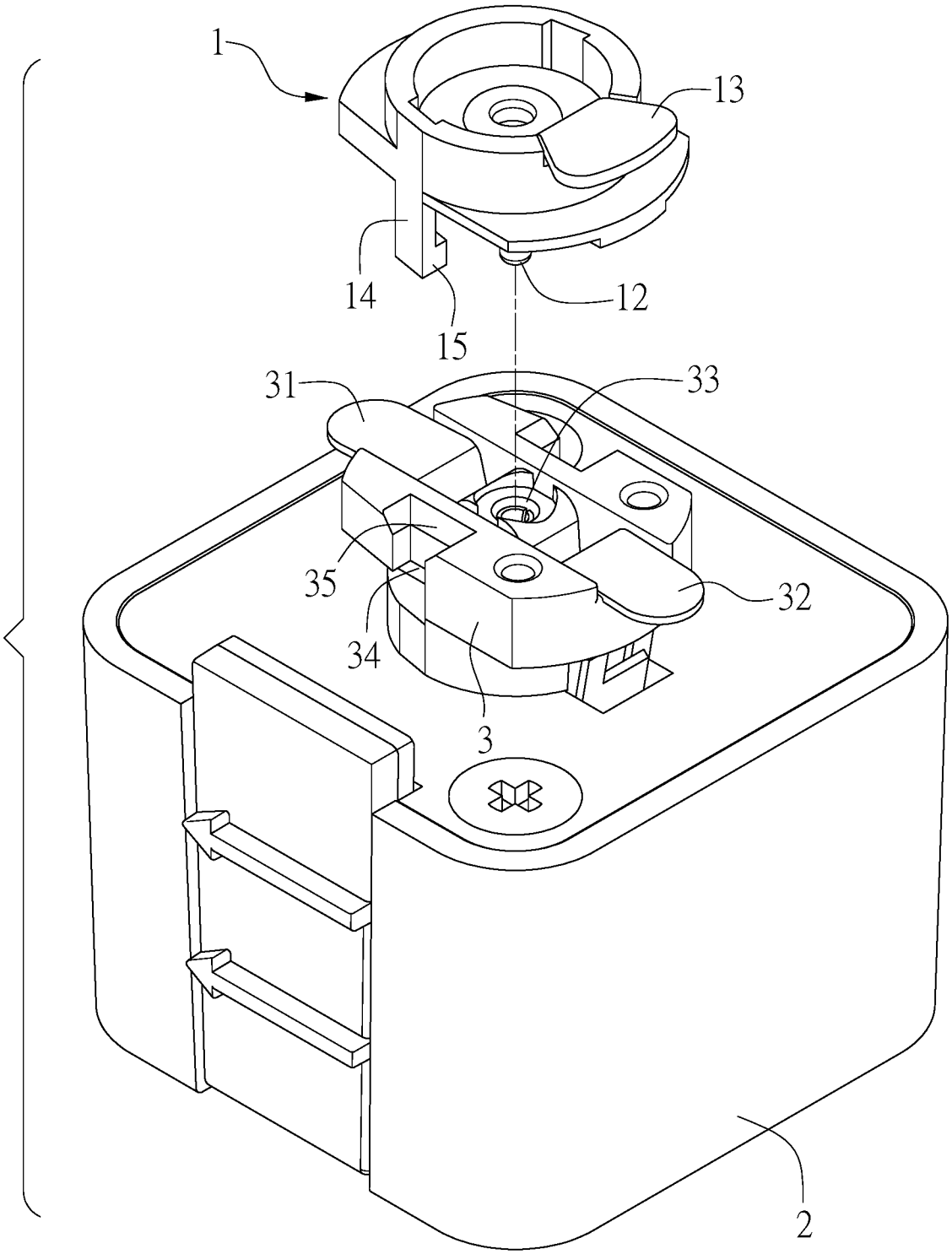
FIG. 3 is an exploded view of the track light of the present invention.
Figure 4:
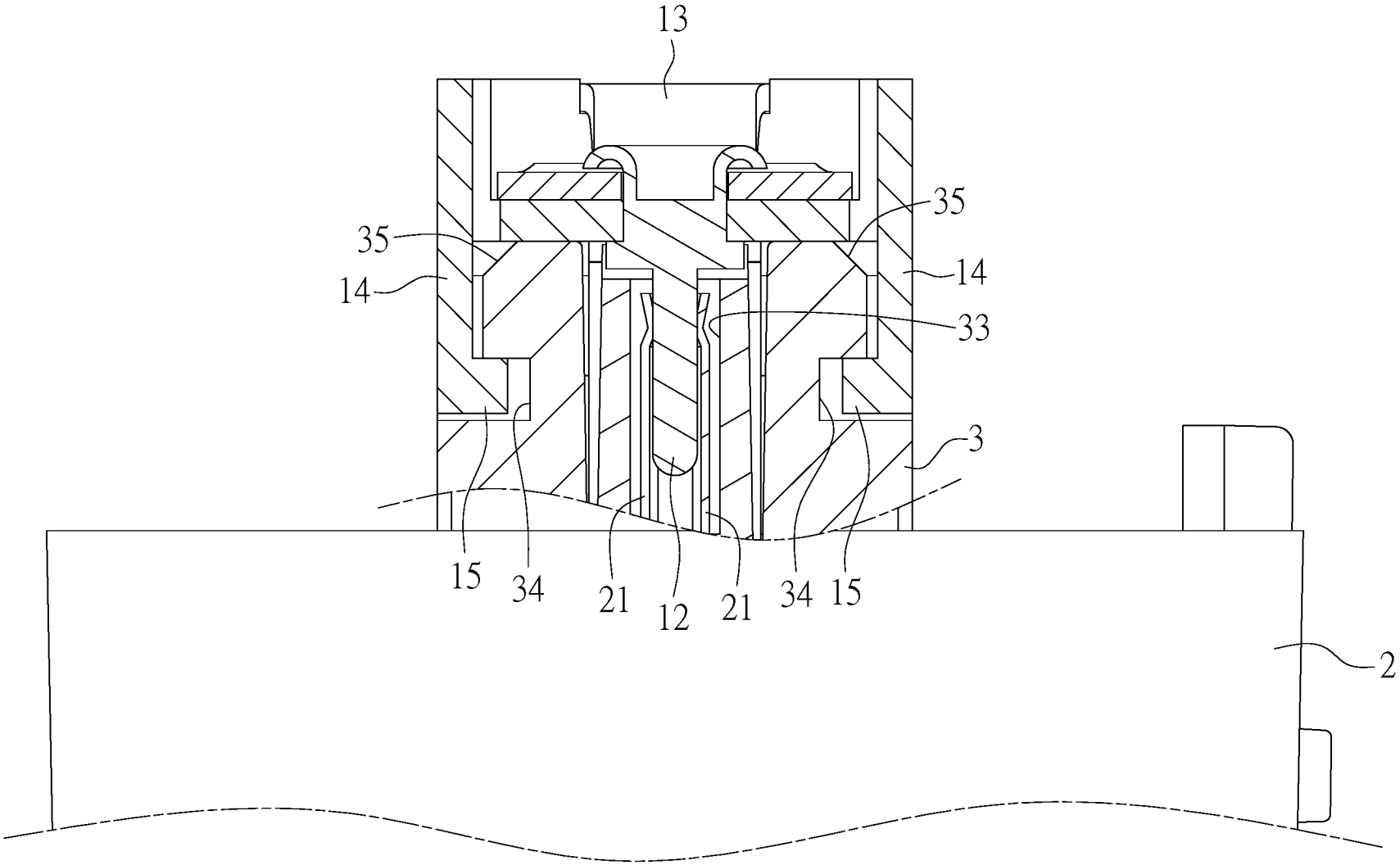
FIG. 4 is a sectional view of the track light of the present invention.

The present invention further discloses a track light structure having the aforementioned earth terminal fitting 1. As shown in FIG. 3, the track light structure comprises a light body 2 and the earth terminal fitting 1. One side of the light body 2 is provided with a terminal block 3 having two conductive terminals extending out from the terminal block 3 for connecting a live wire and a neutral wire of a track, respectively. The terminal block 3 has a socket 33 that is disposed between the two conductive terminals 31, 32 and in communication with the light body 2 for insertion of the pin 12 of the earth terminal fitting 1. As shown in FIG. 4, the pin 12 is electrically connected to the internal circuit 21 of the light body 2, so that the conductive member 13 of the ground terminal fitting 1 is electrically connected to the internal circuit 21 of the light body 2.

Two opposite sides of the terminal block 3 are provided with engaging grooves 34, respectively. The hooks 15 of the claws 14 of the earth terminal fitting 1 are engaged in the engaging grooves 34 respectively, providing a positioning effect. In detail, the earth terminal fitting 1 is mounted on top of the terminal block 3. When the pin 12 is inserted into the socket 33, the two claws 14 cross the terminal block 3 and the hooks 15 are engaged in the engaging grooves 34. Furthermore, the terminal block 3 is provided with a pair of guiding slopes 35 above the engaging grooves 34. The hooks 15 are opened along with the guiding slopes 35 during assembly, which facilitates the hooks 15 to be engaged in the engaging grooves 34.

Figure 5:
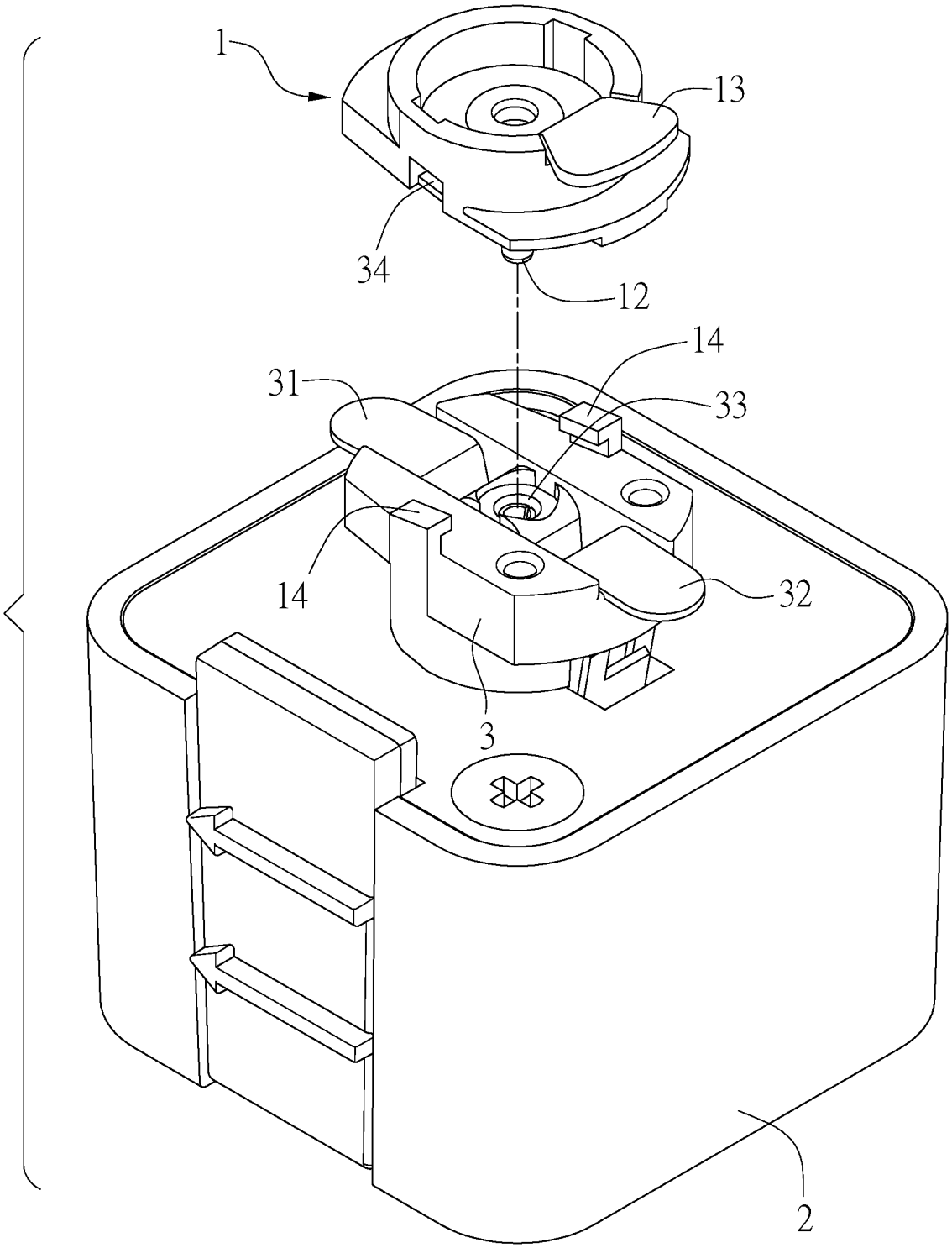
FIG. 5 is an exploded view of another embodiment of the track light of the present invention.

In other embodiments as shown in FIG. 5, the claws 14 may be provided on the terminal block 3 and the engaging grooves 34 may be provided on the base 11 of the earth terminal fitting 1 such that the earth terminal fitting 1 is mounted on the terminal block 3 as well. Furthermore, the assembling between the earth terminal fitting 1 and the terminal block 3 may also be carried out by any other possible structures.

Figure 6:
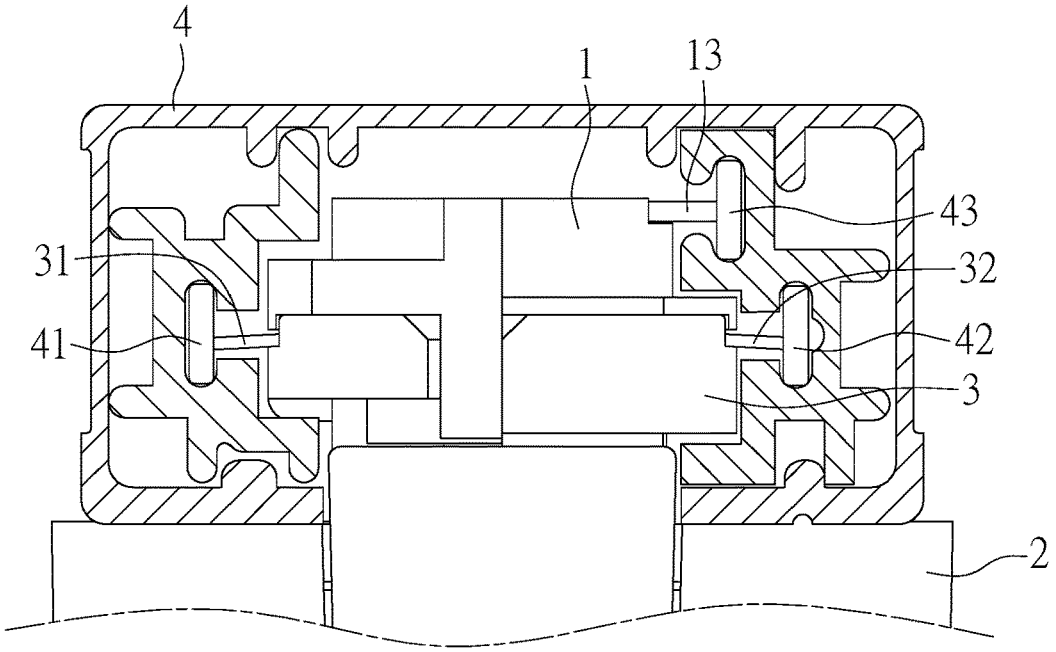
FIG. 6 is a schematic view of the track light mounted to a three-wire track of the present invention when in use.

The track light structure of the present invention may be changed to a three-terminal or two-terminal configuration by assembling or disassembling the earth terminal fitting 1 for a three-wire or two-wire track, improving versatility. As shown in FIG. 6, when the track adopts a three-wire track 4 having a live wire 41, a neutral wire 42 and an earth wire 43 therein, the earth terminal fitting 1 of the track light of the present invention is mounted on top of the terminal block 3 of the light body 2 in the aforementioned assembly manner to constitute a track light having three terminals. The two conductive terminals 31, 32 of the terminal block 3 are connected to the live wire 41 and the neutral wire 42 of the track, respectively. The conductive member 13 of the earth terminal fitting 1 is connected to the earth wire 43 of the track. Thereby, the track light can be properly connected to each circuit in the track to operate normally. The connection between the conductive member 13 and the earth wire 43 maintains the power consumption safety.

Figure 7:
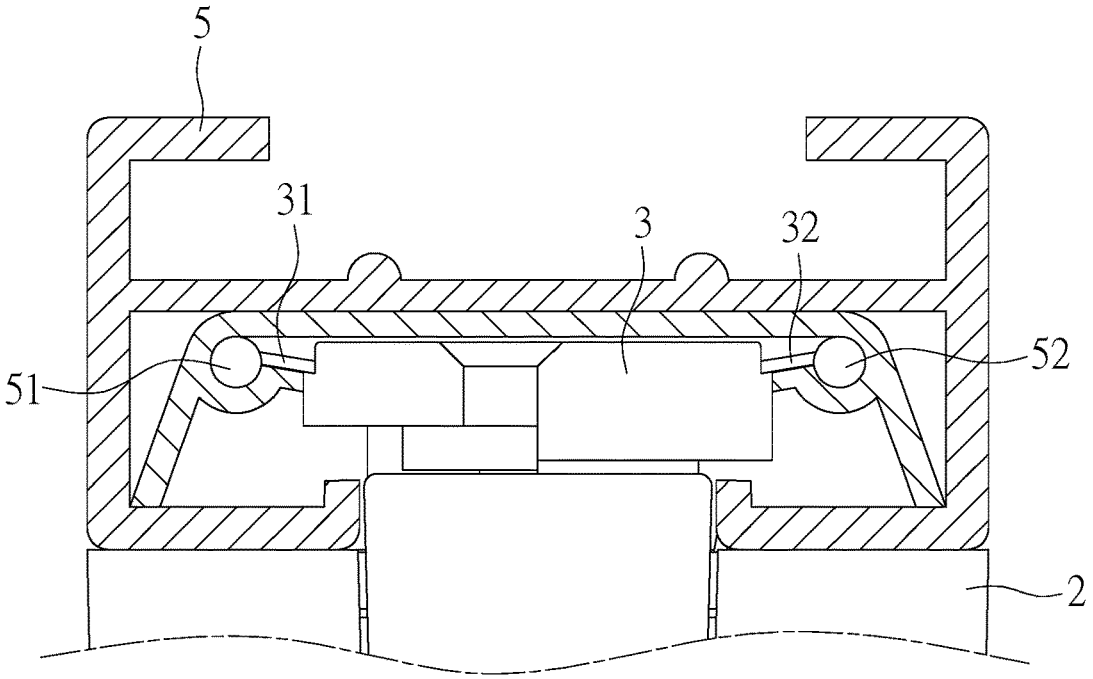
FIG. 7 is a schematic view of the track light mounted to a two-wire track of the present invention when in use.
Figure 8:
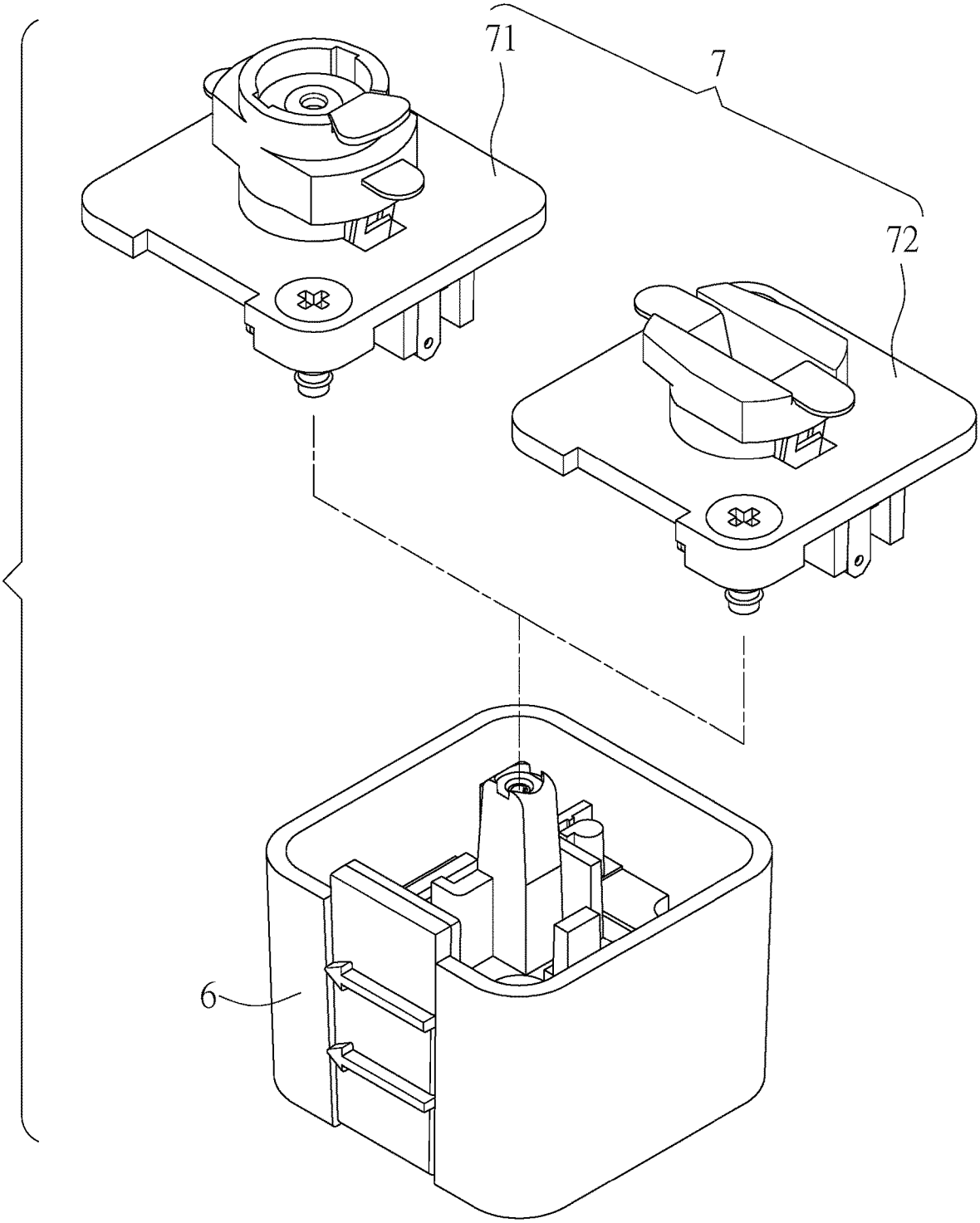
FIG. 8 PRIOR ART
FIG. 8 is an exploded of the light body and the terminal block fitting of the conventional track light.

As shown in FIG. 7, when the track adopts a three-wire track 5 having a live wire 51 and a neutral wire 52 therein, the earth terminal fitting 1 of the track light of the present invention is detached from the track light to become a track light having only two terminals. The two conductive terminals 31, 32 are connected to the live wire 51 and the neutral wire 52 of the track respectively, so that they can be properly connected and operate normally.

As described above, it can be understood that the track light of the present invention can be converted into a corresponding mating structure according to different types of tracks to expand the applicability while reducing the cost.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An earth terminal fitting of a two-terminal style track light, selectively mounted to the two-terminal style track light, the track light having a terminal block with two conductive terminals for connecting a live wire and a neutral wire; the earth terminal fitting comprising:

a base having a pin extending from an underside of the base to be electrically connected to the two-terminal style track light;

a connecting portion disposed on the base to be fixedly connected to the terminal block;

a conductive member disposed on the base and electrically connected to the pin for connecting an earth wire.

2. The earth terminal fitting as claimed in claim 1, wherein the connecting portion is a pair of claws respectively located on opposite sides of the base.

3. A track light structure, comprising:

a light body including a terminal block, the terminal block having two conductive terminals for connecting a live wire and a neutral wire; the terminal block having a socket communicating with the light body;

an earth terminal fitting capable of connecting with the terminal block, having a base with a pin extending from an underside of the base, the pin being inserted into the socket and electrically connected to the light body, the base having a conductive member electrically connected to the pin for connecting an earth wire; the base having a connecting portion for connecting to the terminal block.

4. The track light structure as claimed in claim 3, wherein two opposite sides of the terminal block are provided with engaging grooves, the connecting portion is a pair of claws respectively located on opposite sides of the base, the claws are engaged in the corresponding engaging grooves so that the earth terminal fitting is fixedly connected to the terminal block.

* * * * *